United States Patent [19]

Souders et al.

[11] Patent Number: 4,917,631

[45] Date of Patent: Apr. 17, 1990

[54] MICROWAVE CONNECTOR

[75] Inventors: Ronald A. Souders, Reading; Jorge L. Cabrera, Jeffersonville, both of Pa.

[73] Assignee: UTI Corporation, Collegeville, Pa.

[21] Appl. No.: 279,381

[22] Filed: Dec. 2, 1988

[51] Int. Cl.[4] ..... H01R 17/18

[52] U.S. Cl. ..... 439/583; 439/874

[58] Field of Search ..... 439/578–585, 439/661–663, 805, 675, 874

[56] References Cited

U.S. PATENT DOCUMENTS

| | | | |
|---|---|---|---|
| 3,275,737 | 4/1964 | Caller | 174/89 |
| 3,778,535 | 5/1972 | Forney, Jr. | 174/88 |
| 3,970,355 | 7/1976 | Pitschi | 339/177 |
| 4,053,200 | 10/1977 | Pugner | 339/177 |
| 4,156,554 | 5/1979 | Aujla | 339/177 |
| 4,496,208 | 1/1985 | Spinner | 439/583 |
| 4,545,637 | 10/1985 | Bosshard et al. | 339/177 |
| 4,648,683 | 3/1987 | Botka | 439/583 |
| 4,761,146 | 8/1988 | Sohoel | 439/584 |

OTHER PUBLICATIONS

"ALPEN" parts catalogue, pp. 15–16 (date unknown).

*Primary Examiner*—David Pirlot

*Attorney, Agent, or Firm*—Seidel, Gonda, Lavorgna & Monaco

[57] ABSTRACT

A connector for microwave transmission lines having inner and outer conductors, separated by a dielectric layer. The connector comprises a contact ring surrounding and in physical and electrical contact with the outer conductor. A first end of the contact ring, the outer conductor and the dielectric layer all terminate in a common plane. In one embodiment, the second end of the contact ring extends for a distance between the outer conductor and a wire shield in the cable. In another embodiment, the contact ring engages the outer conductor at one cavity, and engages the outer surface of the shield at a concentric cavity of a larger diameter. A clamp nut movably surrounds the shield along at least the portion of the shield which surrounds the second end of the contact ring and a connector shell removably engageable with the clamp nut surrounds at least the portion of the clamp nut which surrounds the wire shield. The outer conductor, second end of the contact ring, shield, clamp nut and connector shell are in physical contact to provide an electrical path from the outer conductor to the connector shell. Means for preventing axial motion of the inner conductor are provided.

9 Claims, 4 Drawing Sheets

MICROWAVE CONNECTOR

FIELD OF THE INVENTION

The present invention is directed to a connector for microwave transmission lines which provides improved mechanical stability and cable-to-connector retention strength while not significantly altering the electrical path of the transmission line.

BACKGROUND OF THE INVENTION

Microwave transmission lines themselves are well known and often take the form of a flexible or semirigid coaxial cable. Such cables are typically provided with a connector at at least one end of the cable for connecting the cable to a source of microwave energy or to a load. Connectors for microwave transmission lines in the form of coaxial cables are disclosed in, for example, U.S. Pat. Nos. 3,778,535 and 4,545,637. Connectors for coaxial cables for non-microwave uses are disclosed in U.S. Pat. Nos. 3,275,737, 4,053,200 and 4,156,554.

It is also known that there are several important requirements that a microwave connector must satisfy. The connector must present a constant characteristic impedance, must have controlled compensation of electrical discontinuities resulting from unavoidable dimensional changes, must meet close mechanical dimensional tolerances (±0.001 inch), and must not introduce reflections in the microwave transmission line. It is also desirable that the connector provide high cable-to-connector retention strength, so that the connector does not introduce a weak mechanical link in the microwave transmission line. The connector must further provide electrical continuity with minimum ohmic losses and protect the transmission line from environmental effects.

SUMMARY OF THE INVENTION

The present invention provides a connector for microwave transmission lines which meets all of the characteristics required of a microwave connector and, in addition, provides excellent cable-to-connector retention strength without significantly altering the electrical path of the transmission line. The present invention provides a cable-to-connector retention strength on the order of 100% of the tensile strength of the coaxial cable to which the connector is attached, in contrast to prior connectors which offer cable-to-connector retention strengths only about half as great.

The present invention is a connector for microwave transmission lines which have an inner conductor, a low-density polytetrafluoroethylene dielectric layer surrounding the inner conductor, a thin outer conductor surrounding the dielectric layer, a woven wire braid shield surrounding the thin outer conductor and an exterior insulating covering surrounding the shield. The connector comprises a contact ring surrounding and in physical and electrical contact on an interior surface of the ring with the outer conductor. A first end of the contact ring, the outer conductor and the dielectric layer all terminate in a common plane. The contact ring has a second end spaced from the first end of the contact ring. The contact ring has a shouldered portion between the first and second ends thereof for contacting the shield and causing the shield to terminate in a plane parallel to and spaced apart from the common plane of the first end of the contact ring, the thin outer conductor and the dielectric layer. A clamp nut movably surrounds the shield and contact ring along at least a portion thereof, and a connector shell is provided which is removably engageable with the clamp nut and surrounds at least the shouldered portion of the contact ring. The connector shell has an extending portion adapted to receive a coupling nut. The outer conductor, the contact ring, the shield, the clamp nut and the connector shell are all in physical contact to provide an electrical path from the thin outer conductor to the connector shell while keeping a constant characteristic cable impedance.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
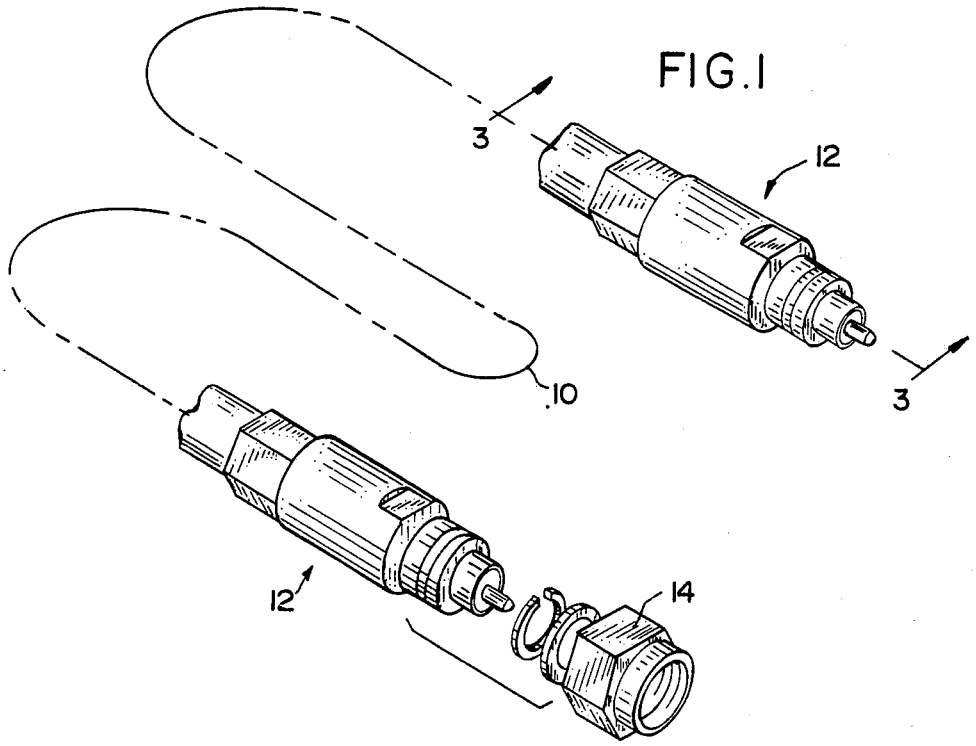
FIG. 1 illustrates in simplified form a microwave transmission line in the form of a coaxial cable fitted at each end with connectors according to the present invention.

Referring now to the drawings, wherein like numerals indicate like elements, there is shown a microwave transmission line in the form of a coaxial cable 10 fitted at each end with a connector 12 according to the present invention. Connector 12 includes a coupling nut 14, shown exploded from connector 12 in FIG. 1, which is rotatably attached to connector 12 to enable connector 12 to be attached to a source of microwave energy or to a load. Coupling nut 14 may be optionally configured as either male or female to mate with a corresponding female or male, respectively, connector on the source or load. Coupling nut 14 may thus be any desired configuration suitable for attaching cable 10 to a source or load, and the particular configuration of coupling nut 14 is not critical to the invention.

Figure 2:
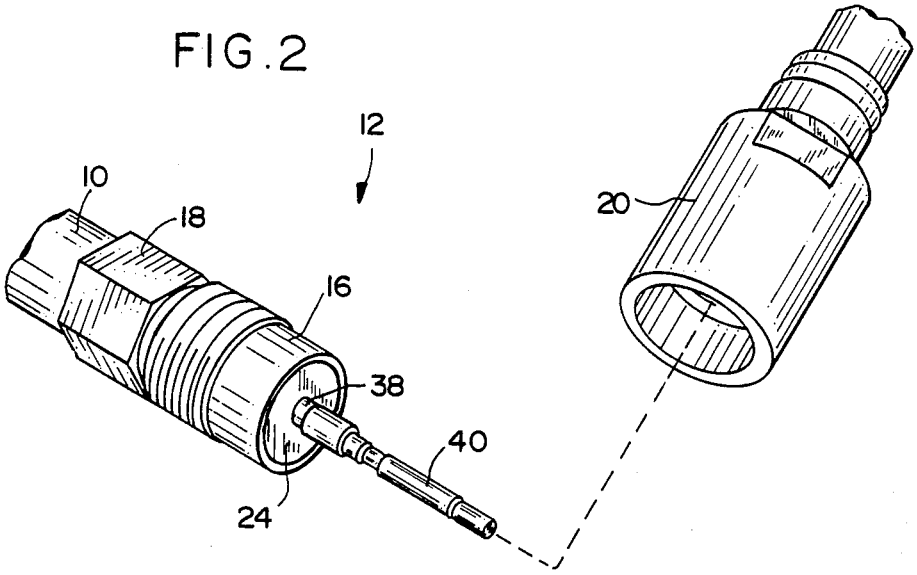
FIG. 2 is a partially-exploded view of a connector according to the present invention showing the connector shell removed from the clamp nut.

The major elements of connector 12 are shown in FIG. 2. Connector 12 comprises a contact ring 16, clamp nut 18 and a connector shell 20, shown exploded from clamp nut 18 in FIG. 2.

Connector 12 is best understood by reference to FIGS. 3–6. As shown in those figures, cable 10 comprises, viewed from the inside out, an inner conductor 22, a dielectric layer 24 concentrically surrounding inner conductor 22, a thin outer conductor 26 concentrically surrounding the dielectric layer 24, a woven wire braid shield 28 concentrically surrounding the thin outer conductor 26, and an exterior insulating covering 30 concentrically surrounding the shield and forming an outer jacket for cable 10.

Outer conductor 26 is preferably, but not necessarily, in the form of a thin conductive ribbon wound spirally with about 40% overlap around dielectric layer 24.

As those skilled in the art will understand, inner conductor 22 and thin outer conductor 26 form the primary electrical path for microwave energy being carried by cable 10. Typically, the center conductor is considered to be the "signal" conductor and the thin outer conductor is considered to be the return, or ground, and acts as an RF (radio frequency) shield. Wire braid 28 is not the RF shield, but acts only as a backup for the thin outer conductor.

Contact ring 16 is provided with a central bore and concentrically surrounds thin outer conductor 26. The interior surface of the bore in contact ring 16 is in close physical and electrical contact with outer conductor 26 and permits a near-perfect transmission line to be maintained in the area of contact between the outer conductor 26 and the interior surface of the bore in contact ring 16. A first end 32 of contact ring 16 abuts an interior shoulder 34 on connector shell 20. As can be seen from the figures, connector shell 20 has a larger diameter interior bore to surround contact ring 16 and clamp nut 18, and a reduced diameter bore 36. Shoulder 34 is formed between the larger diameter bore and reduced diameter bore 36. Thin outer conductor 26 also abuts shoulder 34 of connector shell 20. Thus, first end 32 of contact ring 16, outer conductor 26 and dielectric layer 24 all terminate in a common plane defined by shoulder 34. An end 38 of inner conductor 22 projects beyond the common plane defined by shoulder 34 of connector shell 20. End 38 of inner conductor 32 is received in a pin 40. Pin 40 is substantially coaxial with inner conductor 22 and extends within reduced bore 36 and beyond the end of connector shell 20. A dielectric plug 44 concentrically surrounds pin 40 and supports pin 40 while insulating it from connector shell 20.

Although dielectric layer 24 may be any suitable dielectric, it has been observed that the loss characteristics of the cable are improved when the dielectric layer 24 is made of an extruded low-density polytetrafluoroethylene (PTFE), also known by its trademark "TEFLON." The dielectric constant of solid PTFE ranges from 2.0 to 2.1; "low density" PTFE is defined as having a specific gravity less than 2.0. The loss tangent for a cable made with solid PTFE, for instance, has been observed to be 0.0002; for low-density PTFE, .000064. Clearly, PTFE is very desirable for its electrical properties. However, low-density PTFE does not have the mechanical rigidity of solid PTFE. It has been found that when low-density PTFE is used as a dielectric, flexing forces on pin 40, due to engaging and disengaging connector 12, will cause pin 40 to recede into the cable or pull out from the cable.

To prevent this axial motion of pin 40 or center conductor 22, pin 40 and plug 44 are retained in place, or "captivated", by epoxy 45 in known manner (see, e.g., U.S. Pat. No. 3,292,117). Epoxy 45 engages two oppositely-facing shoulders created by a reduced diameter portion of pin 40.

In the embodiments shown in FIGS. 3–7, a second end 46 of contact ring 16 extends for a distance between outer conductor 26 and wire braid shield 28 so that shield 28 surrounds the second end 46 of contact ring 16. Shield 28 is preferably joined to second end 46 by soldering, such as at 48. Contact ring 16 is provided with a shoulder 50 against which the end of shield 28 abuts. Shoulder 50 defines a plane parallel to the plane of shoulder 34 on connector shell 20 and spaced apart from it. Thus, shield 28 does not terminate in the plane of the first end 32 of contact ring 16 and the ends of outer conductor 26 and dielectric layer 24, but terminates a distance behind it.

Clamp nut 18 movably surrounds a portion of cable 10 and is in physical and electrical contact with at least that portion of shield 28 which surrounds the second end 46 of contact ring 16. Clamp nut 18 is free to rotate with respect to cable 10 and has an externally threaded portion 52 which engages an internally threaded portion 54 of the larger-diameter bore in connector shell 20. When connector shell 20 is threadably engaged with clamp nut 18, there is a direct electrical path from outer conductor 26 to connector shell 20.

Second end 46 of contact ring 16 is provided with a slight chamfer 56 to allow a smooth transition of shield 28 over second end 46. Second end 46 of contact ring 16 provides improved mechanical stability to connector 12 while not disturbing the electrical path of the transmission line. That is, uniform spacing between inner conductor 22 and outer conductor 26 is maintained in the contact area. In addition, by placing the second end 46 of contact ring 16 between the outer conductor 26 and wire shield 28, more surface area of the wire braid 28 can be soldered to second end 46, providing superior mechanical stability between the outer conductor 26 and wire braid 28. The result is a mechanical robustness not found in prior connectors. The present invention allows for a connector-to-cable retention force of at least 100% of the cable tensile strength, as compared to only 50% in prior connectors. Moreover, terminating wire braid 28 behind the plane of the first end of the contact ring, outer conductor 26 and dielectric layer 24 facilitates machining the end of cable 10 to a smooth surface. With the structure of the present invention, the possibility of the braid wires of shield 28 "smearing" over dielectric layer 24 and the resultant likelihood of voids being created between the braid wire is eliminated. This results in a connector with highly consistent electrical characteristics.

Figure 7:
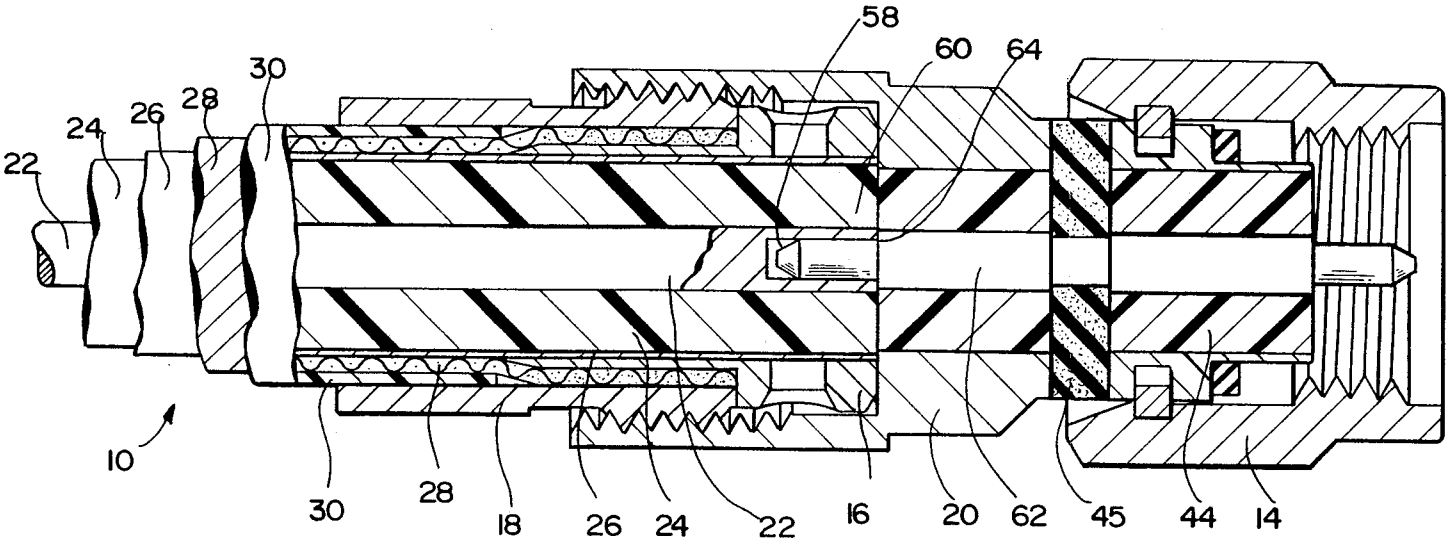
FIG. 7 is a longitudinal sectional view of a portion of a microwave transmission line in the form of a coaxial cable fitted at one end with a connector according to an alternate embodiment of the present invention.

A slightly different embodiment of the connector of the present invention is illustrated in FIG. 7. The embodiment shown in FIG. 7 is the same as the embodiment already described, with the exception of the dielectric plug in connector shell 20 and the pin contact. Instead of the contact receiving an extending end of the center conductor 22, conductor 22 terminates in the common plane of conductor 26, dielectric layer 24 and first end 32 of contact ring 16, and is provided with a socket 58 to receive a shouldered projection 60 on pin contact 62. Projection 60 is preferably soldered in place in socket 58. As seen in FIG. 7, projection 60 has a slight shoulder 64 which abuts the end of center conductor 22. Dielectric plug 44 surrounds and supports pin 62 and abuts dielectric layer 24 of cable 10. In this embodiment there is only a single step, at shoulder 64, from the diameter of conductor 22 to the diameter of pin 62, which allows connector 12 to even more closely approach a reflectionless termination.

Figure 8:
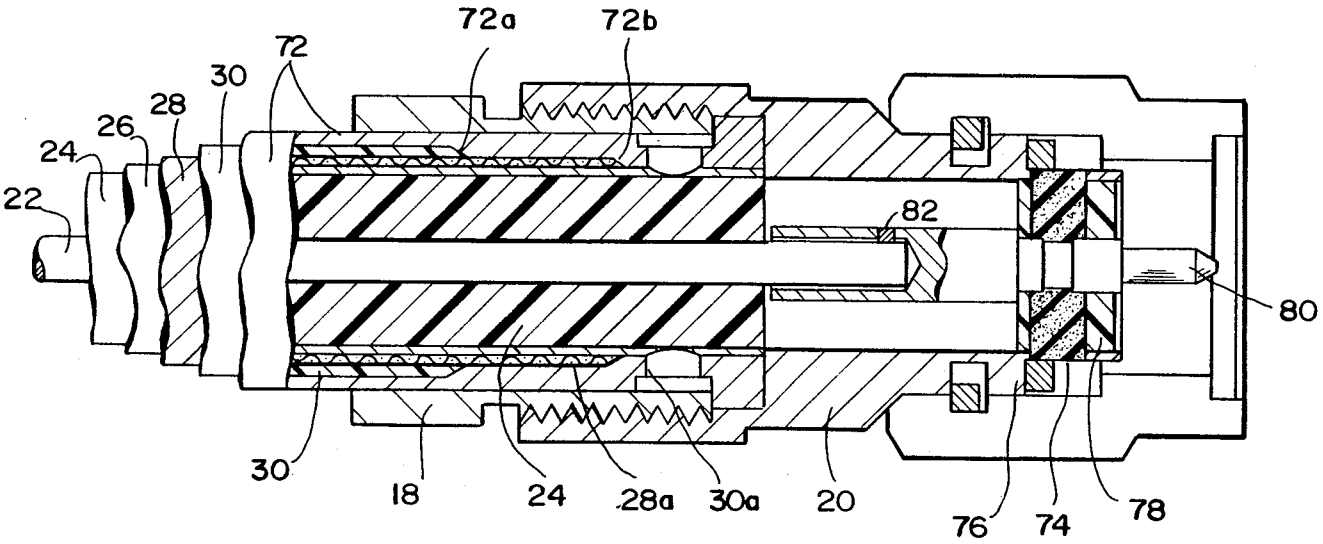
FIG. 8 is a longitudinal sectional view of a portion of a microwave transmission line in the form of a coaxial cable fitted at one end with a connector according to a third embodiment of the present invention.

The embodiment shown in FIG. 8 shows another arrangement of the concentric layers around the conductor 22. It has been found that the loss characteristics through the connector are improved when the shielding braid 28 around the outer conductor 26 terminates at a distance from the plane at which the outer conductor 26 and the dielectric 24 terminate. To allow this arrangement of parts, contact ring 72 fits into clamp nut 18, as with the previous embodiments. However, in embodiment of FIG. 8, contact ring 72 is provided with an axial bore having three different diameter portions on the interior surface of the bore. In the first portion, the diameter of the bore is large enough to receive the entire diameter of cable 10. The next diameter portion is large enough to receive only that part of the cable including wire braid 28 but excluding outer jacket 30. These two diameter portions define an interior shoulder 72*a*, against which jacket 30 abuts. The last diameter portion is only large enough to receive the part of the cable comprising center conductor 22, dielectric 24 and outer conductor 26. The second and last diameter portions define a second shoulder, 72*b*, against which braid 28 abuts. Shoulder 72*b* ensures that braid 28 will terminate a distance from the common plane of center conductor 22, dielectric 24 and outer conductor 26, while allowing the radial distance between center conductor 22 and outer conductor 26 to remain constant all the way to the common plane.

Figures 3, 4, 5, 6:
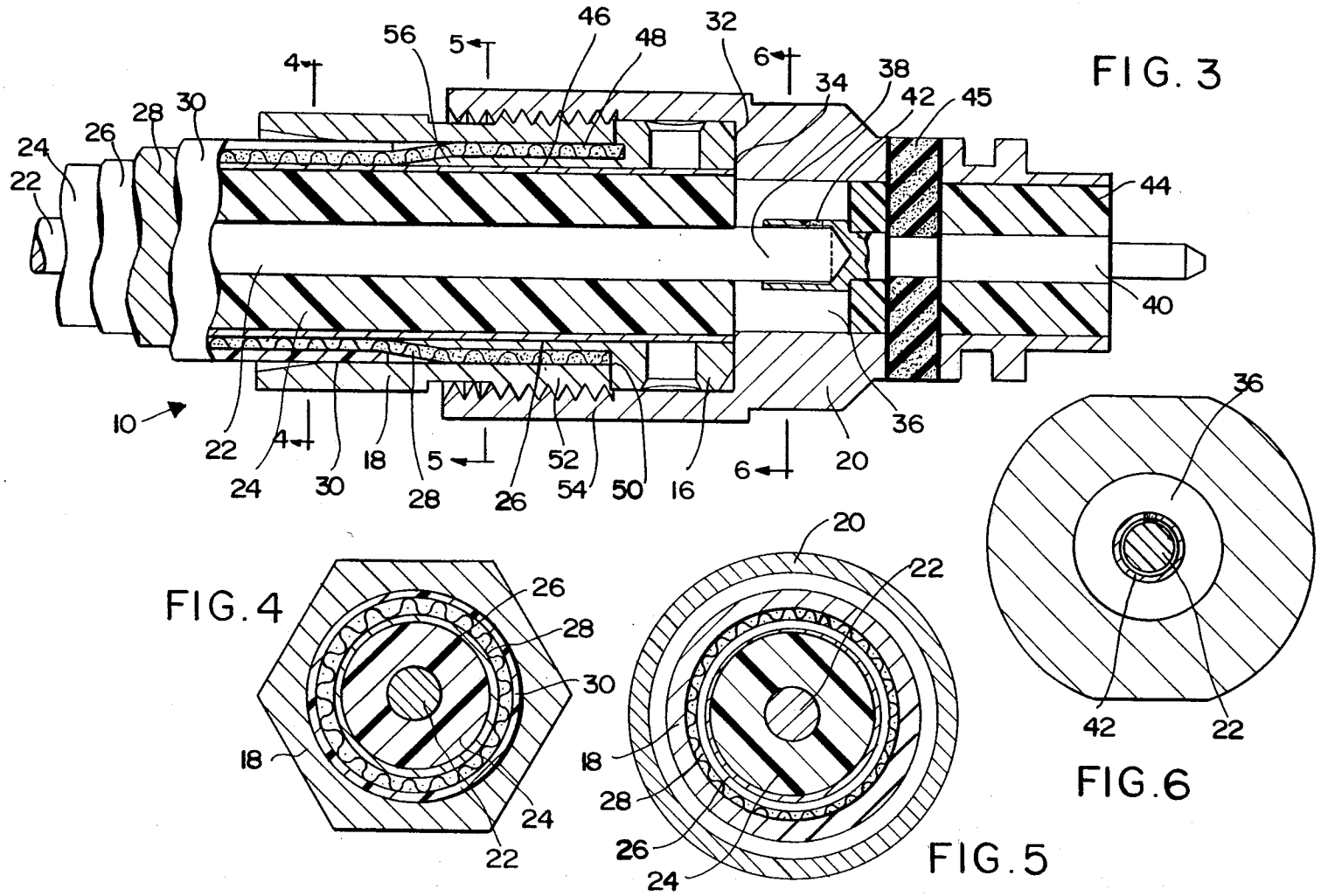
FIG. 3 is a longitudinal sectional view of a portion of the cable and the connector taken along the lines 3—3 of FIG. 1.
FIGS. 4, 5 and 6 are transverse sectional views of the cable and connector taken along the lines 4—4, 5—5 and 6—6, respectively, of FIG. 3.

The embodiment of FIG. 8 also shows another "captivation" technique, which may be used with the embodiments of FIGS. 3 or 7 as well. In this embodiment pin 80 is soldered through opening 82 to the conductor 22. Pin 80 is shaped with a reduced diameter section to form two opposite facing shoulders which are embedded in captivating assembly 74, 76, 78. The shoulders of pin 80 are held by epoxy 74, which thus prevents any axial motion of pin 80 or conductor 22 relative to the connector.

Although the particular captivating assembly 74, 76, 78 is shown in FIG. 8 in conjunction with the contact ring 72, the captivating means of FIG. 8 may be used with the contact ring 16 of FIGS. 3 or 7. Conversely, captivating means 45 shown in FIGS. 3 or 7 may be used in conjunction with contact ring 72 shown in FIG. 8.

The present invention may be embodied in other specific forms without departing from the spirit or essential attributes thereof and, accordingly, reference should be made to the appended claims, rather than to the foregoing specifications, as indicating the scope of the invention.

We claim:

1. A connector for microwave transmission lines having an inner conductor, a low-density PTFE dielectric layer surrounding the inner conductor, a thin outer conductor surrounding the dielectric layer, a woven wire braid shield surrounding the thin outer conductor and an exterior insulating covering surrounding the shield, comprising:

(a) a contact ring surrounding and in physical and electrical contact on an interior surface thereof with the outer conductor, a first end of the contact ring, the outer conductor and the dielectric layer all terminating in a common plane, the contact ring having a second end spaced from the first end, and having a shouldered portion between the first and second ends thereof for contacting the shield and causing the shield to terminate in a plane parallel to and spaced from the common plane of the first end of the contact ring, the outer conductor and the dielectric layer, (b) a clamp nut movably surrounding the shield and contact ring along at least a portion thereof, (c) a connector shell removably engageable with the clamp nut and surrounding at least the shouldered portion of the contact ring, and (d) captivating means adapted to prevent axial movement of said inner conductor, and (e) the outer conductor, the contact ring, the shield, the clamp nut and the connector shell all being in physical contact to provide an electrical path from the thin outer conductor to the connector shell while keeping constant characteristic cable impedance.

2. Connector according to claim 1, wherein an end of the inner conductor projects beyond the common plane, and further comprising a contact pin extending within the connector shell and having a socket at one end of the inner conductor.

3. Connector according to claim 1, wherein an end of the inner conductor terminates at the common plane and is provided with an axial bore in said end, and further comprising a contact, pin having a first end in said bore, a second end which projects beyond the connector shell and a shank portion connecting said first and second ends.

4. Connector according to claim 1, wherein said captivating means adapted to inhibit axial movement of said inner conductor comprises: stop means rigidly attached to said connector shell, a pin rigidly attached to said conductor, said pin comprising a narrowed portion forming two oppositely-facing shoulders, said shoulders adapted to fit into said stop means.

5. A connector for microwave transmission lines having an inner conductor, a low-density PTFE dielectric layer surrounding the inner conductor, a thin outer conductor surrounding the dielectric layer, a woven wire braid shield surrounding the thin outer conductor and an exterior insulating covering surrounding the shield, comprising:

(a) a contact ring surrounding and in physical and electrical contact on an interior surface thereof with the outer conductor, said contact ring having:

(i) a first end, terminating in a common plane with said outer conductor and said dielectric layer, (ii) a second end spaced from said first end, in physical contact on its interior surface with said outer conductor and in physical contact on its exterior surface with the interior surface of said shield, (iii) a shoulder between said first and second ends for causing said shield to terminate in a plane parallel to and spaced from the common plane of the first end of the contact ring, the outer conductor and the contact layer, (b) a clamp nut movably surrounding the shield and contact ring along at least a portion thereof, (c) a connector shell removably engageable with the clamp nut and surrounding at least the shouldered portion of the contact ring, and (d) captivating means adapted to prevent movement of said inner conductor, (e) the outer conductor, the contact ring, the shield, the clamp nut and the connector shell all being in physical contact to provide an electrical path from the thin outer conductor to the connector shell while keeping constant characteristic cable impedance.

6. Connector according to claim 5, wherein said captivating means adapted to inhibit axial movement of said inner conductor comprises: stop means rigidly attached to said connector shell, a pin rigidly attached to said conductor, said pin comprising a narrowed portion forming two oppositely-facing shoulders, said shoulders adapted to fit into said stop means.

7. A connector for microwave transmission lines having an inner conductor, a low-density PTFE dielectric layer surrounding the inner conductor, a thin outer conductor surrounding the dielectric layer, a woven wire braid shield surrounding the thin outer conductor and an exterior insulating cover surrounding the shield, comprising:

(a) a contact ring surrounding said transmission line, having:

(i) an axial bore with a first portion having a diameter corresponding to the outer diameter of the insulating cover, a second portion having a diameter corresponding to the outer diameter of said braid shield, and a third portion with a diameter corresponding to the outer diameter of said outer conductor, (ii) said first and second portions forming a first shoulder in said bore, and said second and third portions forming a second shoulder in said bore, (b) a clamp nut movably surrounding the contact ring along at least a portion thereof, (c) a connector shell removably engageable with the clamp nut and surrounding at least the shouldered portion of the contact ring, (d) captivating means adapted to prevent axial movement of said inner conductor, (e) the outer conductor, the contact ring, the shield, the clamp nut and the connector shell all being in physical contact to provide an electrical path from the thin outer conductor to the conductor shell while keeping constant characteristic cable impedance.

8. Connector according to claim 7, wherein said captivating means adapted to inhibit axial movement of said inner conductor comprises: stop means rigidly attached to said connector shell, a pin rigidly attached to said conductor, said pin comprising a narrowed portion forming two oppositely-facing shoulders, said shoulders adapted to fit into said stop means.

9. Connector according to claim 7, wherein an end of the inner conductor terminates at the common plane and is provided with an axial bore in said end, and further comprising a contact pin having a first end in said bore, a second bore which projects beyond the connector shell, and a shank portion connecting said first and second ends.

* * * * *